United States Patent [19]

Seragnoli

[11] 4,376,484

[45] Mar. 15, 1983

[54] DEVICE FOR CHECKING THE SOUNDNESS OF THE CIGARETTES IN A PACKETING MACHINE

[75] Inventor: Enzo Seragnoli, Bologna, Italy

[73] Assignee: G.D. Societa per Azioni, Bologna, Italy

[21] Appl. No.: 245,955

[22] Filed: Mar. 20, 1981

[30] Foreign Application Priority Data

Apr. 1, 1980 [IT] Italy ..... 3369 A/80

[51] Int. Cl.[3] ..... B07C 5/00; A24C 5/345

[52] U.S. Cl. ..... 209/535; 209/911

[58] Field of Search ..... 209/911, 535, 536, 537; 53/54, 56, 547, 548, 148, 149; 221/268; 131/282; 198/419

[56] References Cited

U.S. PATENT DOCUMENTS

| | | | |
|---|---|---|---|
| 3,207,308 | 9/1965 | Kemp | 209/535 |
| 3,520,394 | 7/1970 | Seragnoli | 53/54 X |
| 3,729,636 | 4/1973 | Merker | 209/536 X |
| 3,771,279 | 10/1971 | Seragnoli . | |
| 4,209,955 | 5/1979 | Seragnoli . | |

*Primary Examiner*—Allen N. Knowles

*Attorney, Agent, or Firm*—Browdy and Neimark

[57] ABSTRACT

A device that can be mounted on an infeed hopper of a cigarette packeting machine, for checking the soundness of the cigarettes in a pile movable along each of the exit channels of the hopper. The device comprises sensor means for checking at least two successive cigarettes per movement cycle of the pile, and at least one ejector device for individual cigarettes, this being placed downstream with respect to the sensor means, in the movement direction of the pile, and controlled by the sensor means.

8 Claims, 2 Drawing Figures

DEVICE FOR CHECKING THE SOUNDNESS OF THE CIGARETTES IN A PACKETING MACHINE

BACKGROUND OF THE INVENTION

The invention relates to a device for checking the soundness of the cigarettes in a packeting machine and, in particular, to a checking device suitable to be mounted on an infeed hopper of a cigarette packeting machine in order to detect and reject any faulty cigarettes before packeting.

In U.S. Pat. No. 3,520,394 in the name of the same Applicant as herein, a description is given of a hopper for the containment of a mass of cigarettes, the lower part of which is divided up into the same number of branches or elementary hoppers as there are layers of cigarettes (generally three) in one complete batch to be packeted.

Each elementary hopper is, in turn, partitioned with strips or baffles to form channels of a roominess approximately greater than the diameter of one cigarette, the number of these corresponding to the number of cigarettes (normally six or seven) that constitute one layer.

Layers of juxtaposed cigarettes are thus formed in the region of the bottom or outlet mouth of each of the elementary hoppers, and are fed, one layer at a time, into the pockets of an endless, intermittently moving, conveyor.

Through superposition, the layers gradually become, in the inside of the pockets, complete batches that the inching conveyor transfers to wrapping means.

In accordance with what is known and described, for example in U.S. Pat. No. 3,771,279 in the name of the same Applicant as herein, means for checking the soundness of the cigarettes are provided in the region of the channels or, alternatively, along the path followed by the endless conveyor.

The checking means can, for example, be of electromechanical type and comprise sensor means constituted by feeler pins which, by axially stressing the extremities of the cigarettes, check the degree of filling thereof.

The result of the checking operation is then sent, through a memory device, to means for ejecting batches wherein there are one or more faulty cigarettes, placed along the path followed by the endless, intermittently moving, conveyor.

The checking and ejecting system, though advantageous from a practical viewpoint, is decidedly uneconomical since a complete batch of cigarettes is expelled because of just one faulty cigarette.

SUMMARY OF THE INVENTION

The object of this invention is to provide a device of the above mentioned type with which it is possible to overcome, at least in part, the problem described in relation to the known art, and with which it is possible to expel at least a part of the faulty cigarettes before they arrive at the aforementioned inching conveyor.

This object is attained with the present invention by a device for checking the soundness of the cigarettes in a packeting machine, the device being mounted on an infeed hopper of a packeting machine in order to check the soundness of the cigarettes in a pile of cigarettes that is movable in steps along each of the exit channels of the hopper. The device is characterized in that it comprises sensor means for effecting at least two checking operations per stepping movement of the pile; and at least one ejector device for individual cigarettes, placed along the channel, downstream with respect to the sensor means, in the movement direction of the pile, and controlled by the sensor means.

BRIEF DESCRIPTION OF THE DRAWINGS

Further characteristics and advantages of the device according to the invention will become apparent from the description that follows of one form of embodiment, given as a not limiting example and illustrated in the accompanying drawings, in which.

DESCRIPTION OF THE PREFERRED EMBODIMENT

Figure 1:
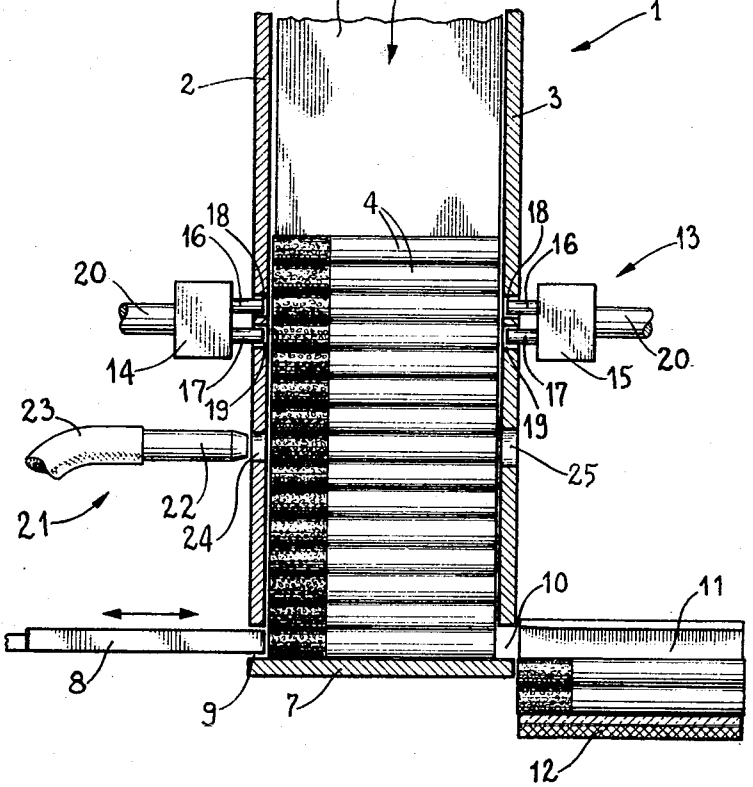
FIG. 1 shows, diagrammatically, in an elevation view, a checking device according to the invention, mounted on a hopper of a cigarette packeting machine.

In FIG. 1 is illustrated an infeed hopper 1, in itself known, of a non-illustrated cigarette packeting machine.

The hopper 1 is delimited by a front wall 2 and a back wall 3 placed in a vertical position, one parallel with the other, which define a compartment of a width only slightly greater than the length of one cigarette 4, divided up into a plurality of elementary channels 5 (only one of which is illustrated) by the walls 6 (only one of which is illustrated in FIG. 1) placed at a distance away from one another only slightly greater than the diameter of one cigarette 4.

The lower part of the elementary channel 5 is delimited by a horizontal wall 7 against which the columns of cigarettes 4 contained in the channels 5 rest. Contact with batches of the cigarettes 4 is made by a pusher member 8 that reciprocates in a horizontal direction, perpendicularly to the walls 2 and 3, through horizontal slits 9 and 10 formed in the walls 2 and 3 in a position adjacent to the wall 7, the height of these being at least equal to the diameter of one cigarette 4.

The pusher member 8 is movable from a non-operative position outside the hopper 1, illustrated in FIG. 1, to a working position inside the hopper 1 for driving the cigarettes 4 from the channels 5 into the inside of the containers 11 (only one of which is illustrated) carried by an intermittently moving conveyor belt 12 that transfers batches of cigarettes 4 towards a non-illustrated packeting group, via non-illustrated ejection means designed to discharge from the conveyor belt 12 any batch of cigarettes 4 containing one or more faulty cigarettes.

To understand better the structure of the hopper 1, the channels 5 and the pusher member 8, as well as of the conveyor belt 12 and the cited non-illustrated ejection means, reference should be made to the description given in U.S. Pat. Nos. 3,771,279 and 4,209,955 in the name of the same Applicant as herein.

Provided alongside each channel 5 there is a device, shown generally at 13, for checking the soundness of the individual cigarettes 4, comprising two opposite sensors or feelers 14 and 15 that palpate the extremities of the individual cigarettes 4, each equipped with two pins 16 and 17 in alignment with and opposite the corresponding pins 16 and 17 of the other sensor, these extending through the holes 18 and 19, respectively, drilled in the walls 2 and 3.

The two pins 16 and the two pins 17 define two checking positions, inter-staggered at a distance that virtually corresponds to the diameter of one cigarette 4, coincident with the positions adopted by two adjacent cigarettes 4 at every one of the pause phases of the pile in the inside of the channel 5.

The pins 16 and 17 are mounted in an elastic manner on the sensors 14 and 15, respectively, and they move with a reciprocating motion through the corresponding holes 18 and 19 under the thrust of pusher members 20 that operate synchronously in opposite directions. Beneath the checking device 13, outside the wall 2 and in what is called the expulsion position that is staggered with respect to the position of the pins 16 and 17 by a distance equal to or a multiple of the diameter of one cigarette 4, provision is made for an ejector device 21 constituted by a nozzle 22 connected, via a pipe 23, to a non-illustrated source of compressed air, able to direct a virtually horizontal blast of air through a hole 24 and into the channel 5.

On the wall 3 of the hopper 1, a hole 25 for discharging the rejected cigarettes 4 has been drilled in alignment with the hole 24.

Figure 2:
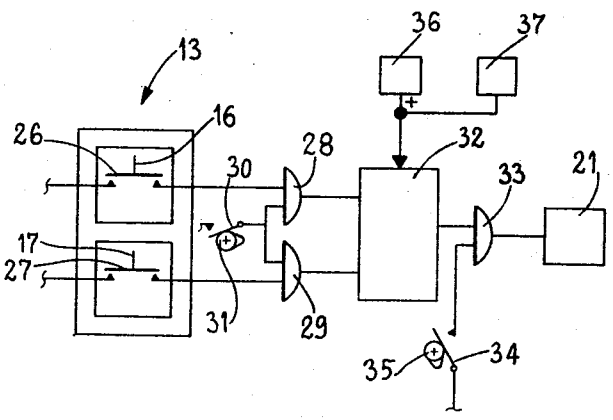
FIG. 2 shows, in a block diagram, the device depicted in FIG. 1, with the relevant electrical checking and ejecting parts thereof.

As can be seen in the block diagram in FIG. 2, the two pairs of pins 16 and 17 of the checking device 13 carry the contacts 26 and 27 which are normally in an open condition and close when a faulty cigarette 4 is detected. Shown in FIG. 2 at 28 and 29 there are two twin input AND logical elements. The lines comprising the contacts 26 and 27 terminate at one input of the AND elements 28 and 29, respectively. The second input of the AND elements 28 and 29 is connected to a common line comrprising a consent contact 30 closed cyclically by a cam 31 rotatable synchronously with the pusher member 8. At 32 there is a memory to which the output signals of the two AND logical elements 28 and 29 flow. Provision is made at 33 for a third AND logical element, of which one output is connected to the ejector device 21, and two inputs terminate at the memory 32 and at a line comprising a consent contact 34, respectively, the latter closed cyclically by a cam 35 rotatable synchronously with the cam 31. The memory 32 is controlled through a shift signal generated by a counting circuit 36 which counts any faulty cigarettes that may be present in between the position of the sensors 14 and 15 and that of the ejector device 21, and emits signals that are added to those emitted by a circuit 37 that counts the machine cycles.

At each machine cycle, in the condition in which the pile of cigarettes pauses inside the channel 5, the two pairs of pins 16 and 17 probe, through the holes 18 and 19, the extremities of the two cigarettes 4 placed in alignment with the said holes.

Leaving aside for the moment the pair of pins 17; in cases when the two pins 16 check a cigarette and find no fault, the contact 26 stays in the open condition. In the said circumstance, the AND logical element 28 does not send any signal to the memory 32 or, indirectly, to the ejector device 21.

When the contrary occurs, that is to say, one or both pins 16 detect, in at least one extremity of the cigarette being checked, an insufficient degree of filling or, in the case of filter cigarettes, that the filter is missing, the contact 26 closes.

In this particular condition, the AND element 28 sends, synchronously with the closing of the contact 30 on the part of the cyclic cam 31, an operating signal to the memory 32.

The latter, with a cycle retard that corresponds to the time needed for the faulty cigarette to reach the expulsion position, sends a signal to the AND logical element 33.

The said AND element 33, at the time the pile of cigarettes 4 is in the pause condition inside the channel 5 and synchronously with the closing of the contact 34 on the part of the cyclic cam 35, sends an expulsion order to the ejector device 21.

The nozzle 22 emits a blast of air that causes the faulty cigarette 4 to exit from the channel 5 through the hole 25 and, consequently, the entire overhead pile of cigarettes 4 to immediately drop downwards by an amount that corresponds to the diameter of one cigarette.

This means that during one and the same cycle, two cigarettes occupy in succession the upper checking position defined by the pins 16.

Bearing in mind that the checking device 13 is, hypothetically, set up to perform a checking operation at each operating cycle, the reason for the presence of the second pair of pins 17 is clear.

The cigarettes that evade the checking operation on the part of the pins 16 in the operating cycles during which an expulsion operation takes place, are subjected to a check in the subsequent cycle on the part of the pins 17 in the region of the lower checking position.

The same result can of course be obtained by providing, during each operating cycle, two checking operations on the part of a device constituted, for each channel 5, by one individual pair of pins 16 or 17. In such an event, the said two checking operations have necessarily to be carried out during the pause phase of the piles of cigarettes, prior to and after, respectively, the interval of time destined for the operating cycle of the ejector device 21; in other words, before the closing of the contact 34 and after said contact has reopened.

The sensors 14 and 15 described, inclusive of the pins 16 and 17, can be replaced with sensors of any other type (for example, electrical, electro-optical or pneumatic) supported by the walls 2 and 3 in the region of each channel 5.

Likewise, the ejector device 21, which in the embodiment described herein is of the pneumatic type, could also be a mechanical pusher member.

It can be seen from the foregoing description that with the device 13–21 that is able to effect two checks in succession on the soundness of the cigarettes 4 and comprises one single ejector device 21, it is possible to expel isolated faulty cigarettes but not a faulty cigarette preceded by another faulty cigarette.

To be more precise, when a number of faulty cigarettes are present in succession inside the channel 5, the ejector device 21 only expels one faulty cigarette in each pair of adjacent faulty cigarettes.

When considering a pair of adjacent faulty cigarettes, it can, in fact, be seen that following the expulsion of the first faulty cigarette, the second one drops down in the region of the expulsion position but is not subjected to a subsequent operation of the ejector device 21 because of the entire pile of cigarettes present in the channel 5 dropping down by one step due to the pusher member 8 returning to its nonoperative position.

In spite of the above described problem, the usefulness remains of the device 13–21 since it has been statistically proved that, in known machines, the expulsion of more than 90% of the complete batches of cigarettes (twenty cigarettes) on the part of the conventional ejector devices is due to the presence of one single, isolated, faulty cigarette per batch.

It follows, from what has been outlined above, that in the event of it is desired to be able to eject two adjacent faulty cigarettes, provision would have to be made along the channel 5 for three quality checks and two expulsion actions.

On the basis of the foregoing, there would have to be n+1 checks and n expulsion actions in order to be able to expel n adjacent faulty cigarettes.

While the invention has been described in detail above, it is to be understood that this detailed description is by way of example only, and the protection granted is to be limited only within the spirit of the invention and the scope of the following claims.

What is claimed is:

1. A device for checking the soundness of cigarettes fed to a cigarette packeting machine, a cigarette infeed hopper for said packeting machine, means to feed said cigarettes through said hopper in steps of one cigarette at a time in single file transversely to their axes, means to mount said checking device on said hopper, said checking device comprising a plurality of N in number of cigarette soundness sensor means, and cigarette ejector means all arranged closely adjacent the ends of said cigarettes as they move through said hopper and in predetermined spaced relation to each other with said ejector means downstream of all of said sensor mens, all N of said sensor means each performing a checking operation on each single cigarette step motion of said cigarettes through said hopper, means to coordinate the operations of all N of said sensor means and said ejector means together with the operation of said means to feed said cigarettes through said hopper to eject a faulty cigarette sensed by any one of said N number of sensor means by said ejector means, and said N number of sensor means being operative to detect and to cause said ejector means to eject (N−1) faulty cigarettes in succession and also to assure that every cigarette in said hopper will be checked as to soundness at least once.

2. Device according to claim 1, wherein said sensor means are able to check at least two successive cigarettes per stepping movement of said cigarettes in said hopper pile.

3. Device according to claim 1, wherein said sensor means are able to perform at least two checking operations in the same position along said cigarettes in said hopper channel per stepping movement of the said pile.

4. Device according to claim 1, wherein said hopper is substantially vertically oriented and gravity aids in feeding said cigarettes therethrough.

5. Device according to claim 1, wherein N equals two.

6. Device according to claim 5, wherein said two sensor means are separated from each other by a distance substantially equal to the diameter of one cigarette.

7. Device according to claim 1, wherein said ejector means comprise an air blower.

8. Device according to claim 1, wherein said sensor means comprise tactile pin means.

* * * * *